United States Patent [19]

Jurisov

[11] Patent Number: 4,955,551

[45] Date of Patent: Sep. 11, 1990

[54] INTERMITTENT EPICYCLIC MILL

[76] Inventor: Vitaly V. Jurisov, Tsvetnoi proezd, 17, kv. 40, Novosibirsk, U.S.S.R.

[21] Appl. No.: 348,007

[22] PCT Filed: Aug. 19, 1988

[86] PCT No.: PCT/SU88/00161

§ 371 Date: Apr. 20, 1989

§ 102(e) Date: Apr. 20, 1989

[87] PCT Pub. No.: WO89/01363

PCT Pub. Date: Feb. 23, 1989

[30] Foreign Application Priority Data

Aug. 20, 1987 [SU] U.S.S.R. ..... 4296981

[51] Int. Cl.[5] ..... B02C 17/08

[52] U.S. Cl. ..... 241/175

[58] Field of Search ..... 241/175, 176, 179, 137; 51/163.2, 164.2, 163.1

[56] References Cited

FOREIGN PATENT DOCUMENTS

| | | | |
|---|---|---|---|
| 117671 | 8/1958 | U.S.S.R. . | |
| 604578 | 4/1978 | U.S.S.R. | 241/175 |
| 631198 | 11/1978 | U.S.S.R. . | |
| 782865 | 11/1980 | U.S.S.R. | 241/175 |
| 874181 | 10/1981 | U.S.S.R. . | |
| 961760 | 9/1982 | U.S.S.R. . | |

*Primary Examiner*—Mark Rosenbaum

*Attorney, Agent, or Firm*—Fleit, Jocobson, Cohn, Price, Holman & Stern

[57] ABSTRACT

An intermittent epicyclic mill incorporating a housing (1) with a cover (3) contained wherein are revolvable barrels (27), having lids and carrying each a load of pebbles (64), and a carrier (18) which supports the barrels and is linked to an electric drive. A rigid mount (10) restricting the barrels (27) which are pressed thereto by load-bearing elements fitted to the carrier (18) is provided in the housing (1) in a coaxial position with the carrier (18). A revolving jib crane (9) fitted to a baseplate (2) carries a ram (7) in a coaxial position with the mill a piston rod (6) whereof is rigidly attached to the cover (3) of the housing (1). A spindle (31) carrying a lower disc (33) and an upper disc (43) is fastened to the inside of the cover (3). The lower disc (33) is installed with provision for turning with the lids of the barrels (27). The upper disc (43) is provided with spring-loaded pins (45) and is fitted with provision for axial displacement relative to the lower disc (33). Rams (46) interacting with the upper disc (43) when the cover (3) of the housing (1) is being lifted by the ram (7) of the revolvable jib crane (9) are fitted to the cover (3) of the housing (1).

11 Claims, 3 Drawing Sheets

INTERMITTENT EPICYCLIC MILL

TECHNICAL FIELD

The present invention relates to size reducing machinery coping with mechanical and chemical processing of materials and has specific reference to intermittent epicyclic mills.

BACKGROUND OF THE INVENTION

Known in the art is an intermittent epicyclic mill (SU, A, 117,671) incorporating a housing with a cover, barrels with lids and loads of pebbles which are linked to planet wheels of a planetary gear, and a drive, whereby each barrel is fitted to a mount—which is fixed to a planet wheel—and is provided with an overhanging clamp comprising an eccentric and a pushrod interacting with the barrel lid. The pushrod can consist of two lengths connected by a spring.

The barrel lids are opened and closed by the hand-operated eccentrics, and the opening and closing of the housing cover is a manual job as well. Therefore, the attending personnel is exposed to the harmful effect of the toxic stock processed and may suffer from poisoning and occupational diseases, putting them on the sick list.

Also known is an intermittent epicyclic mill (SU, A, 961,760) incorporating a baseplate-supported housing with a cover contained wherein are barrels revolving about their own axes and the axis of the mill. The barrels rest on a carrier, are provided with lids and contain each a load of pebbles. The carrier is electrically driven.

The fasteners of the barrel lids and housing cover are done and undone by hand. Therefore, when toxic stock containing, e.g., mercury, fluorine, barium, etc. being processed, the personnel is exposed to its hazardous effect with grave consequences for their health.

DISCLOSURE OF THE INVENTION

It is an object of the present invention to provide an epicyclic mill which can be operated unattended in an isolated space and process materials, predominantly of toxic character, at a high rate.

This object is realized by disclosing an intermittent epicyclic mill incorporating a housing with a cover which is supported by a baseplate and located wherein are barrels—closed by lids and containing each a load of pebbles—resting on an electrically-driven carrier and revolving both about their own axes and an axis of the mill whereby according to the invention a rigid mount is immovably located in the housing in a coaxial position with the carrier so as to form a clearance with the housing and restrict the barrels which are pressed against the rigid mount by load-bearing element fitted to the carrier; a revolving jib crane is secured to the baseplate; a ram is suspended from the jib crane in a coaxial position with the mill, whereby the piston rod of the ram is rigidly attached to the cover of the housing; a spindle is rigidly fastened to the inside of the cover of the housing so as to give support to two discs installed in bearings one above the other, whereby the lower disc is fitted with provision for revolving integrally with the lids of the barrels and the upper disc—installed with provision for an axial displacement with respect to the lower disc—has spring-loaded pins passing through holes in the lower disc so as to come abutting against the top end faces of the barrels; and rams are fitted to the cover of the housing with provision for interacting with the upper disc when the cover of the housing is being lifted by the ram of the revolving jib crane.

The clearance, the mount fits into the housing with, provides for uniform thermal expansion of the mount in the radial direction and prevents its cocking which may induce heavy vibration shortening the service life of the mill. The rigid mount serves as a friction surface owing whereto the centrifugal forces of the masses of the barrels can be utilized in order to induce the rotation of the barrels about their own axes. The load-bearing elements fitted to the carrier press the barrels against the rigid mount in operation, preventing thereby the possibility of radial oscillations of the barrels and extending the service life of the friction surfaces of both the rigid mount and the barrels. The ram of the revolving jib crane which is located in the coaxial position with the mill and is rigidly attached with its piston rod to the cover of the housing serves to lift the cover of the housing integrally with the lids of the barrels and return the cover on the housing and the lids into charging openings of the barrels. During an up-and-down motion of the piston rod of the ram relative to the jib of the revolving crane the cover of the housing and the lids of the barrels turn through 180° and reverse their travel through the same angle. The spindle attached to the lower side of the cover of the housing carries two revolvable discs. The lower disc is linked to the lids of barrels fitting into the charging openings of the barrels so as to render air-tight the spaces therein. The upper disc is fitted with spring-loaded pins which are rigidly attached thereto and pass through holes in the lower disc with provision for axial displacement so as to come abutting against the end faces of the barrels. The rams at the cover of the housing are arranged so as to displace with their pistin rods, if necessary, the upper disc with their spring-loaded pins in the axial direction, i.e. downwards until the spring-loaded pins come abutting against the end faces of the barrels. This arrangement is required in order to bring about a thrusting action between the barrels and their lids when the cover of housing and the lids of barrels—spring-loaded rods being involved in this latter case—are being lifted by the ram of the revolving jib crane. The spring-loaded pins of the upper disc serve to return this disc into the initial position when the piston rods of the rams also return into their initial position, i.e. when they displace upwards.

It is expedient that the load-bearing elements consist of a central spring-loaded cone located in the axis of the mill and of radial spring-loaded arms—the number whereof equals that of the barrels—which surround the cone all the way along the circumference thereof and contact each the cone at one end and carry a yoke with a plain bearing embracing the corresponding barrel at the other end.

A downward motion of the central spring-loaded cone causes the spring-loaded arms in contact with the side surface thereof to move outwardly in the radial directions all at a time integrally with the yokes and the plain bearings which consequently come abutting against the side surfaces of the barrels and press these against the rigid mount with a force which prevents radial oscillations of the barrels in operation. An upward motion of the central spring-loaded cone due to the action of a spring the cone is fitted with disengages the arms therefrom so that these displace inwardly in the radial directions due to the action of their springs integrally with the yokes and plain bearings and relieve the barrels of the pressure. A clearance is set up between the plain bearings and the barrels which enables these to be easily removed from, and fitted back on, the mill.

It is also expedient that the spindle rigidly fastened to the inside of the cover of the housing has a through drilling located wherein is a spring-loaded pushrod interacting with the central cone.

When the cover of the housing is closed, the pushrod acted upon by a spring holds the central spring-loaded cone in its lower-most position. In other words, the spring-loaded pushrod contained in the through drilling of the spindle displaces the central spring-loaded cone downwards so that the spring-loaded arms press the yokes with the plain bearings against the side surface of the barrels which in their turn are pressed against the rigid mount.

It is further expedient that the lid of every barrel consists of a disc with taper side surface matching the inside surface of the charging opening of the barrel and a spring-loaded rod which supports this disc and works in bearings of the lower disc carried by the spindle.

The taper surfaces of the discs provide for air-tightness of the spaces inside the barrels and prevent pivoting of the lids in the charging openings of barrels, all the more that the angle of the contacting taper surfaces of the discs and charging openings is one bringing about sizing. Bearings provided on the lower disc constrain the spring-loaded rods both axially and radially. The axial constraint of the spring-loaded rods facilitates the fitting of the lids into, and the taking them down from, the barrels. The radial constraint minimizes friction, for the spring-loaded rods rotate integrally with the barrels relative to the lower disc. The spring-loading of the rods and, consequently, that of the discs are indispensable for the sake of air-tightness of the charging openings of barrels.

It is preferred that the taper surface of each disc is in a damping material.

The damping material like rubber or fluoroplastic slightly distorts when the taper-face lids are forced into the barrels. The forces coming into play due to this distortion not only permit the lids to sit firmly in the charging openings of the barrels but ensure air-tightness of the charging openings. Plasticity of the damping material is an adjunct in this case.

It is also preferred that a flat pressure ring overlaying the rods supporting the discs of barrels is provided on the inside surface of the cover of the housing, being connected to the cover by spring-loaded fasteners.

The flat pressure ring acting on the spring-loaded rods exerts extra pressure on the discs of barrels which keeps the discs tight in the charging openings of the barrels and distorts the damping material of the taper disc surfaces for the sake of air-tightness.

It is further preferred that additional rams are provided on the cover of the housing with provision for interacting with the flat pressure ring when the piston rod of the ram of the revolving jib crane is on a downstroke.

The additional rams apply extra force to the lids of barrels through the flat pressure ring and the spring-loaded rods when the lids are placed into the charging openings of the barrels while the piston rod of the ram of the revolving jib crane is on a downstroke.

It is advisable that the lower disc supported by the spindle is linked to the carrier by means of guide rods.

The guide rods transmit a torque from the carrier to the lower disc, relieving thus the spring-loaded of the lids of barrels from this function and adding to the stability of the lids of barrels fitting into the charging openings of the barrels.

It is desired that the jib of the revolving jib crane is linked to the cover of the housing with the aid of a guide pin.

The guide pin excludes any possibility of the cover of housing to be turned accidentally about its geometric axis in the topmost position, i.e. when the housing is being open, and prevents misalignment of the lids of barrels with respect to the barrels which may follow such a turn.

It is also desired that the upper disc is provided with an annular breaking lining.

The breaking lining, e.g. one made of rubber, the upper disc is fitted with augments the cohesive friction forces set up between the end faces of the piston rods of the rams - fitted to the cover of housing - and the upper disc with the result that the upper and lower discs acquire stability and the lids of barrels stay in alignment with the charging openings of the barrels when the revolving jib crane is in operation.

It is further desired that arresters are attached to the lower disc to check axial displacements of the upper disc.

The arresters of axial displacement of the upper disc relieve of tension the springs of spring-loaded pins. They also clamp the upper disc between their end faces and the end faces of the piston rods of the rams fitted to the cover of housing, safe-guarding the upper disc against turning relative to the spindle.

SUMMARY OF THE DRAWINGS

The invention will now be described by way of examples of a preferred embodiment thereof with reference to the drawings, wherein.

BEST MODE FOR CARRYING OUT THE INVENTION

Figure 1:
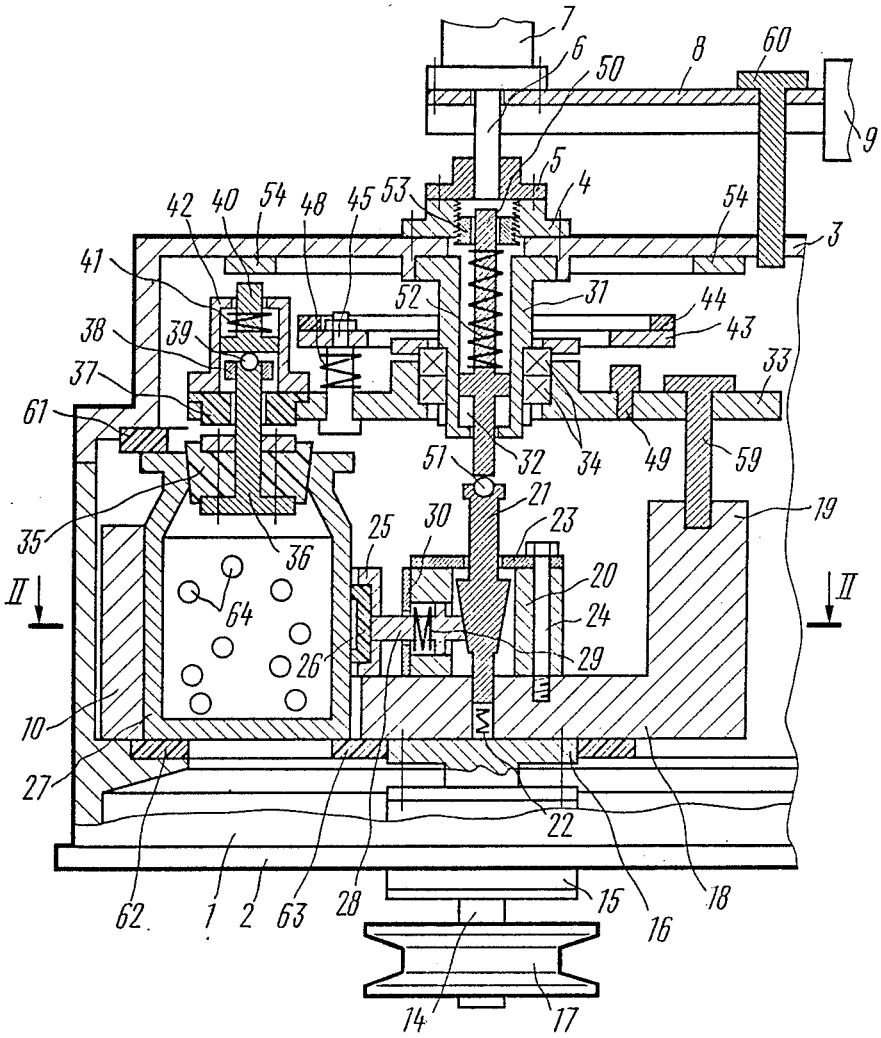
FIG. 1 is a schematic sectional elevation of the intermittent epicyclic mill, according to the invention.
Figure 2:
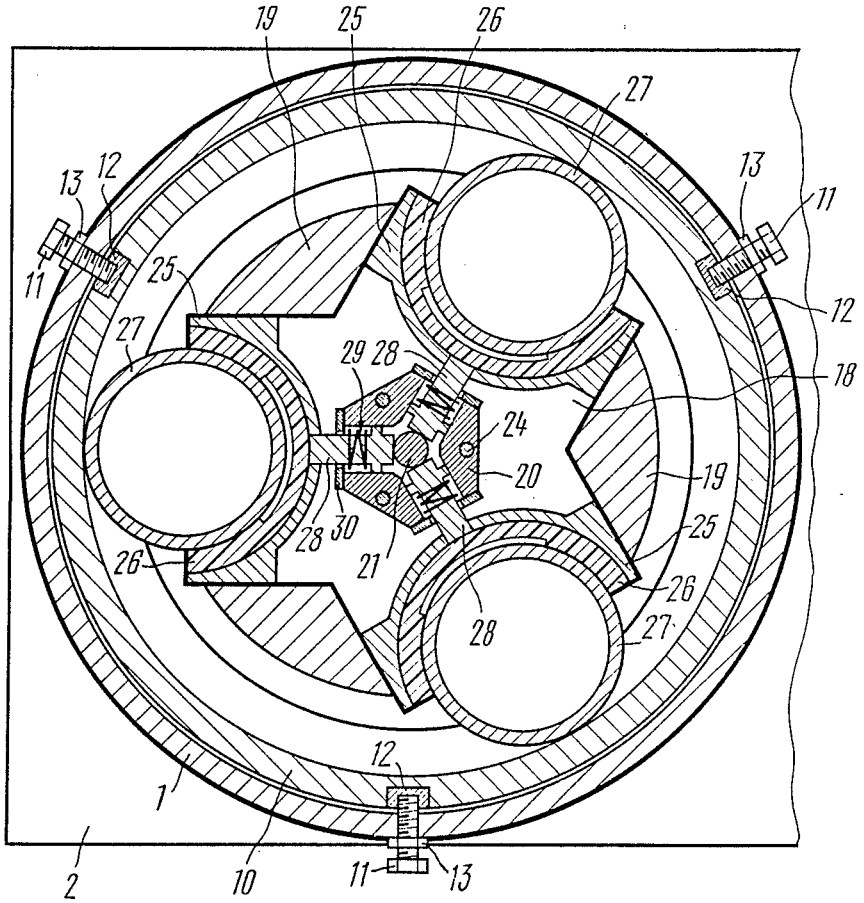
FIG. 2 is a section on line II—II of FIG. 1.
Figure 3:
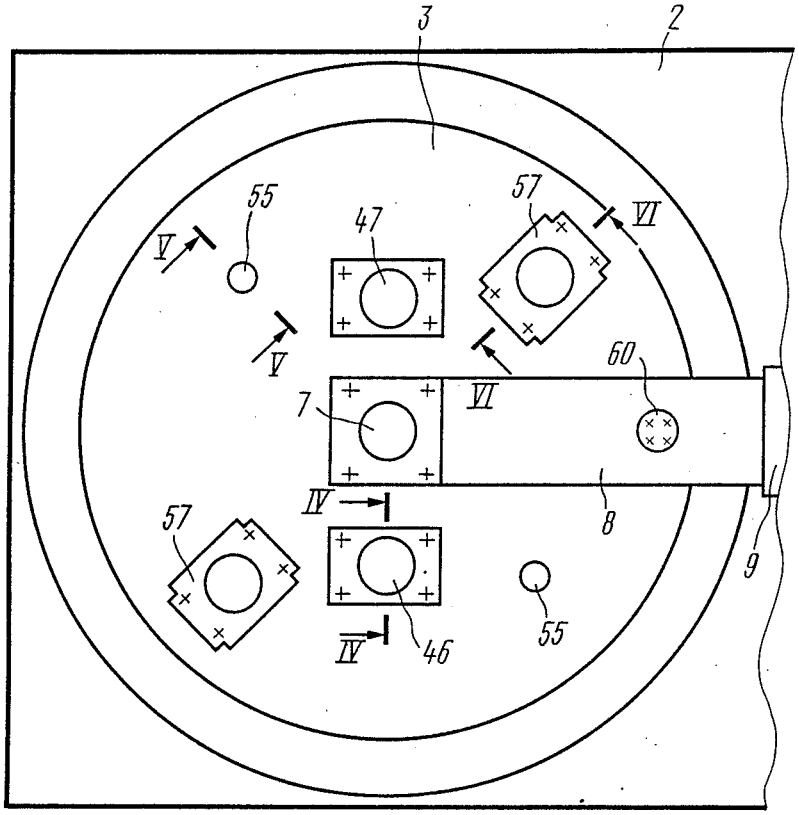
FIG. 3 is a schematic plan view of the intermittent epicyclic mill.
Figure 4:
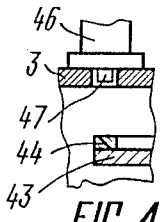
FIG. 4 is a section on line IV—IV of FIG. 3, shown in a turned position.
Figure 5:
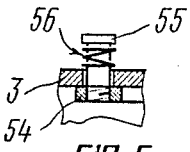
FIG. 5 is a section on line V—V of FIG. 3, shown in a turned position.
Figure 6:
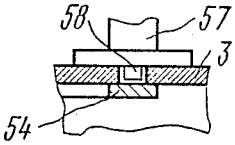
FIG. 6 is a section on line VI—VI of FIG. 3, shown in a turned position.

Referring to FIG. 1, the intermittent epicyclic mill incorporates a housing 1 which rests on a baseplate 2 and has a cover 3. The cover 3 has a flange 4 bolted to a thrust plate 5 which is suspended from a piston rod 6 of a ram 7 fitted to a jib 8 of a revolving jib crane 9 in a coaxial position with the mill. The jib crane 9 is installed on the baseplate 2 and is of any known design (shown fragmentary). A coaxial rigid mount 10 is located in the housing 1 with a clearance, being secured by bolts 11 (FIG. 2) with antivibration inserts 12 made, e.g., of copper and lock nuts 13. The mill is electrically driven through a shaft 14 (FIG. 1) which is supported in a bearing assembly 15 of the housing 1 and is fitted with a half-coupling 16 and a pulley 17. A carrier 18 with uprights 19 is secured to the half-coupling 16 of the shaft 14. Fitted to the shaft 14 is a transfer box 20 contained wherein, and located on the carrier 18, there are load-bearing elements consisting of a central spring-loaded cone 21, yokes 25 with plain bearings 26 and radial spring-loaded arms 28. The central cone 21 acted upon by a return spring 22 is located in a coaxial position with the mill and is constrained in its axial displacement upwards by a hold-down plate 23 secured by bolts 24 integrally with the transfer box 20. The yoke 25 with the plain bearings 26 embraces barrels 27. The radial arms 28 contact the side surface of the central spring-loaded cone 21 and are fitted with return springs 29 interposed between collars of the arms 28 and retaining plates 30 attached to the transfer box 20. A spindle 31 with a through drilling 32 is secured to an inside surface of the cover 3 of the housing 1 in a coaxial position with the mill and carries two discs disposed one above the other. The lower disc 33 is linked to the spindle 31 by bearings 34 and revolves with lids of the barrels 27. The lid of each barrel is formed by a disc 35 and a spring-loaded rod 36 supported in bearings 37 fitted to the lower disc 33. The taper side surface of the disc 35 matches the inside surface of charging opening of the barrel 27 and is made of a damping material, e.g. fluoroplastic or resin-impregnated laminated cloth. The spring-loaded rods 36 are keyed to the discs 35 fitting with their taper side surfaces into the charging openings of the barrels 27, carry check rings 38 and are linked to caps 42 through ball-and-socket joints 39 and pistons 40 with springs 41. The caps 42 are secured to the lower disc 33 integrally with the bearings 37. The upper disc 43 with an annular breaking lining 44 overhangs the lower disc 33 and has spring-loaded pins 45 rigidly attached thereto. The spring-loaded pins 45 pass through holes in the lower disc, being sliding fits thereinto, and link so the two discs 33, 43 to each other. Rams 46 (FIG. 3) with piston rods 47 (FIG. 4) are fitted to the cover 3 (FIG. 1) of the housing 1. The piston rods 47 (FIG. 4) are arranged to displace the upper disc 43 axially. Return springs 48 (FIG. 1) reverse the travel of the upper disc 43. Arresters 49 of axial displacement of the upper disc 43 are fitted to the lower disc 33 so as to clamp the upper disc 43 between their end faces and the end faces of the piston rods 47 (FIG. 4) of the rams 46 (FIG. 3). A spring-loaded pushrod 50 (FIG. 1) contained in the through drilling 32 of the spindle 31 interacts with the central spring-loaded cone 21 through a ball-and-socket joint 51 due to the tension of a spring 52 which can be adjusted by an adjusting nut 53. A flat pressure ring 54 is fixed to the inside surface of the cover 3 of the housing 1 above the pistons 36 by fasteners 55 (FIG. 5) with springs 56. Additional rams 57 (FIG. 3) installed on the cover 3 act upon the flat pressure ring 54 (FIG. 1) with their piston rods 58 (FIG. 6) when the piston rod 6 (FIG. 1) of the ram 7 is on a downstroke. Guide rods 59 link the lower disc 33 to the uprights 19 of the carrier 18 and serve to synchronize the rotary motion of the carrier 18 with that of the lower disc 33 and transmit a torque from the carrier 18 to the lower disc 33. A guide pin 60 links the jib 8 of the revolving jib crane 9 to the cover 3 of the housing 1 so as to prevent the cover 3 from rotating about its own axis in the topmost position. An upper collar 61 of the cover 3 and lower collars 62, 63 of the housing 1 prevent axial displacements of the barrels 27. A load of pebbles 64 is placed into each barrel 27 through the charging openings.

In operation, an electric motor of specified rating sets the carrier 18 with the uprights 19 into motion through the pulley 17, the shaft 14 and the half-coupling 16. The uprights 19 transmit the rotary motion of the carrier 18 to the yokes 25 with the plain bearings 26 which not only embrace the barrels 27 but are pressed against the side surfaces thereof due to the tension of the spring 52 transmitted via the spring-loaded pushrod 50, the ball-and-socket joint 51, the central spring-loaded cone 21 and the spring-loaded radial arms 28. Since the spring 52 also presses the barrels 27 against the rigid yoke 10 in the above-said way, the barrels 27 will not only revolve integrally with the carrier 18—being in the state of transportation—but will be revolved about their own axes by cohesive frictional forces coming into play between them and the rigid yoke 10—being thus also in the state of relative motion as well. The cohesive frictional forces are set up between the barrels 27 and the rigid yoke 10 due to the tension of the spring 52 at starting and stopping the mill and mainly due to centrifugal forces of the masses of the barrels 27 when the mill is in operation. The lids of the barrels 27 revolve integrally with the barrels 27, for the taper side surfaces of the discs 35 match the inside surface of the charging openings of the barrels 27 at an angle bringing about sizing. This ensures stability of the lids of the barrels 27 in operation. Adding to this stability is also the fact that the centre of mass of the lids is located below the top end face of the barrels 27 and a calculated action of the springs 41 is applied to the discs 35 through the pistons 40, the ball-and-socket joints 39 and the spring loaded rods 36, these being rigidly attached to the discs 35. Three factors contribute thus to a firm fit of the lids of the barrels 27 into the charging openings of the barrels 27: the self-sizing of the taper side surfaces of the discs 35 in the inside surfaces of the charging openings of the barrels 27, the downward displacement of the centre of mass of the lids below the top end faces of the barrels 27 and the tension of the springs 41. To ensure that the tension which the springs 41 exert on the spring-loaded rods 36 is constant in operation, the speed of the transportation of the carrier 18 with the uprights 19 and barrels 27 must be synchronized with that of the lower disc 33 carrying the springs 41. This synchronization is effected with the aid of the guide rods 59 which relive the spring-loaded rods 36 of transmitting the torque to the lower disc 33, for otherwise the spring-loaded rods 36 transmitting the torque to the lower disc drastically impair the stability of the discs 35 with the loss of airtightness by the barrels 27 as an outcome. The bearings 37 in resin-impregnated laminated cloth are employed mainly in opening the lids of the barrels 27 when the mill has been stopped. They also can provide support for the spring-loaded rods 36 and the discs 35 in an emergency when the lids of the barrels 27 may come off their seats for some reason or other. The transportation and relative motion of the barrels 27 cause the spherical pebbles 64 and the material which is being ground to move inside the barrels 27 in epicyclic patterns giving rise to centrifugal and Coriolis forces owing to which the particles of the material and the pebbles 64 strike against each other and the walls of the barrels 27 in an intricate way, causing a specified size reduction of the material.

A point to be noted is that in operation the ram 7 presses the cover 3 to the housing 1, exerting a calculated force which is transmitted through the piston rod 6, the thrust plate 5 and the flange 4. The rams 47 (FIG. 4) and the additional rams 57 (FIG. 3) are inoperative at this stage, their piston rods 46 (FIG. 4) and 58 (FIG. 6), respectively, being set into the topmost position.

When a grinding cycle comes to an end and the mill is stopped, the cover 3 (FIG. 1) of the housing 1 and the lids of the barrels 27 are opened from a control desk in the following sequence of events.

The rams 47 (FIG. 4) are set into operation. As their downward-travelling piston rods 46 come abutting against the annular breaking lining 44, they move downwards the upper disc 43 (FIG. 1) integrally with the spring-loaded pins 45 passing through the holes in the lower disc so that the springs 48 become compressed and the spring-loaded pins 45 come abutting with their end faces against the upper end faces of the barrels 27, pressing their bottoms to the lower collars 62, 63. The piston rod 6 of the ram 7 lifts the cover 3 of the housing 1 through the thrust plate 5 and the flange 4 until the thrust plate 5 comes abutting against the jib 8 of the revolving jib crane 9. The check rings 38 fitted to the spring-loaded rods 36 of the lids of the barrels 27 come abutting against the bearings 37 located on the lower disc 33 and tear the discs 35 of the barrels 27 off their seats in the charging openings of the barrels 27. After that, the piston rods 46 (FIG. 4) of the rams 47 continue their downstroke motion for some time more until they come abutting against the arresters 49 (FIG. 1) of axial displacement, clamping the upper disc 43 between the annular breaking lining 44 and the end faces of the arresters 49. Since the upper disc 43 is linked to the lower disc 33 by the spring-loaded pins 45, there is a guarantee that the lower disc 33 can never turn about its axis by accident. As a result, the discs 35 of the lids of the barrels remain always in alignment with the axes of the barrels 27, provided the carrier 18 is at standstill. A known interlocking device may take care of this. When the cover 3 of the housing 1 is being opened, i.e. lifted by the piston rod 6 of the ram 7, the guide rods 59 leave the uprights 19 of the carrier 18, the spring-loaded pushrod 50 disengages the ball-and-socket joint 51 and the central spring-loaded cone 21 displaces upwards due to the tension of the spring 22 so as to come abutting against the hold-down plate 23. As the central spring-loaded cone 21 displaces upwards, the return springs 29 move the radial spring-loaded arms 28 inwardly towards the axis of the mill so that the yokes 25 with the plain bearings 26 are set apart from the side surfaces of the barrels 27. The clearance so formed permits the barrels 27 to be withdrawn from, and returned into, the mill with the aid of, e.g., a gantry robot. The cover 3 of the housing 1, on being lifted so as to contact the jib 8, is turned through 180° by the revolving jib crane 9 and a known slewing mechanism (not shown) which is fitted to the base plate 2.

The loaded barrels 27 are set back into the mill by a gantry robot of any known design.

The procedure of closing the cover 3 of the housing 1 and the lids of the barrels 27 is as follows.

On being turned back through 180°, the cover 3 of the housing 1 is suspended above the housing 1, whereby the slewing mechanism of the revolving jib crane 9 puts the axis of the cover 3 in alignment with that of the housing 1 within a specified interval. The rams 47 (FIG. 4) are cut out and the springs 48 (FIG. 1) return the upper disc 43 with the spring-loaded pins 45 into the original position, i.e., into the topmost one as far as it will go. The additional rams 57 (FIG. 3) are set into operation, displacing with their piston rods 58 (FIG. 6) the flat pressure ring 54 (FIG. 1) downwards against the action of the springs 56 (FIG. 5) slipped on the spring-loaded fasteners 55. As the ring 54 (FIG. 1) comes abutting against the pistons 40, it augments the force set up by the spring-loaded rods of the lids of the barrels 27 to a calculated value owing to which the discs 35 firmly settle down into the charging openings of the barrels 27. The piston rod 6 of the ram 7, acting through the intermediary of the thrust plate 5 and the flange 4, places the cover 3 back on the housing 1. The discs 35 of the barrels 27 fit with their taper side surfaces into the charging openings of the barrels 27, the guide rods 59 fit into the uprights 19 of the carrier 18, and the spring-loaded pushrod 50 acted upon by the spring 52 presses on the ball-and-socket joint 51 so that the central spring-loaded cone 21 moves downwards against the action of the return springs 22 and 29. In moving down against the action of the return springs 29, the central spring-loaded cone 21 displaces outwardly the spring-loaded radial arms 28 contacting the side surface of the cone 21 so that the yokes 25 with the plain bearings 26 embrace the barrels 27 and press them against the rigid mount 10. The additional rams 57 (FIG. 3) are cut out and the ring 54 is pressed by the springs 56 (FIG. 5) against the inside surface of the cover 3 of the housing 1. The ram 7 continues to operate, pressing the cover 3 against the housing 1 in service. The mill is now ready to resume operation.

Unlike the prior art intermittent epicyclic mills, the disclosed one can be operated unattended in isolated spaces in company with robots giving it their helping hand. Therefore, the disclosed mill is suitable for comminuting toxic materials. Moreover, the disclosed mill may be of utility in automatic production lines as a means of fine and superfine grinding of inorganic materials. Paving the way to such applications are the rams which are used on the mill to open and close the cover of the housing and the lids of the barrels and which lend themselves readily to automation by any known method.

INDUSTRIAL APPLICABILITY

In industrial applications, the present invention may be of utility in automatic production lines as a means of fine and superfine grinding, mixing and reacting toxic stocks, e.g., those containing mercury, fluorine, barium and the like. Moreover, the present invention may find application in research as well for the fine and superfine grinding, mixing and reacting of toxic materials at the laboratory, and in preparing solid solutions.

I claim:

1. An intermittent epicyclic mill incorporating a housing (1) with a cover (3) which is supported by a baseplate (2) and wherein located in said housing are barrels (27) closed by lids and containing each a load of pebbles (64), the barrels (27) resting on an electrically-driven carrier (18) and revolving both about their own axes and an axis of the mill, characterized in that a rigid mount (10) is immovably located in the housing (1) in a coaxial position with the carrier (18) so as to form a clearance with the housing (1) and restrict the barrels (27) which are pressed against the rigid mount (10) by load-bearing elements fitted to the carrier (18), and a revolving jib crane (9) is secured to the baseplate (2), the jib crane carrying a ram (7) suspended therefrom in a coaxial position with the mill, the ram having a piston rod (6) rigidly attached to the cover (3) of the housing (1), the inside of the cover having a spindle (31) rigidly fastened thereto so as to give support to a lower disc (33) and an upper disc (43) installed in bearings (34) one above the other, the lower disc (33) is fitted with provision for revolving integrally with the lids of the barrels (27), and the upper disc (43) is installed with provision for an axial displacement with respect to the lower disc (33) and has spring-loaded pins (45) passing through holes in the lower disc (33) so as to come abutting against top end faces of the barrels (27), and rams (46) are fitted to the cover (3) of the housing (1) with provision for interacting with the upper disc (43) when the cover (3) of the housing (1) is being lifted by the ram (7) of the revolving jib crane (9).

2. An intermittent epicyclic mill as claimed in claim 1, characterized in that the load-bearing elements consist of a central spring-loaded cone located in the axis of the mill and of radial spring-loaded arms (28) the number whereof equals that of the barrels (27) and which surround the cone all the way along the circumference thereof and contact each the cone (21) at one end and carry a yoke (25) with a plain bearing (26) embracing the corresponding barrel (27) at the other end.

3. An epicyclic mill as in claim 1, characterized in that the spindle (31) fastened to the inside of the cover (3) of the housing (1) has a through drilling (32) accommodated wherein is a spring-loaded pushrod (50) interacting with the central cone (21).

4. An epicyclic mill as in claim 1, characterized in that the lid of every barrel (27) consists of a disc (35) with taper side surface matching the inside surface of the charging opening of the barrel (27) and a spring-loaded rod (36) which supports this disc (35) and works in bearings (37) of the lower disc (33) carried by the spindle (31).

5. An epicyclic mill as in claim 4, characterized in that a taper side surface of the discs (35) is in a damping material.

6. An epicyclic mill as in claim 1, characterized in that a flat pressure ring (54) is provided on the inside of the cover (3) of the housing (1) above the spring-loaded rods (36) supporting the discs (35) of the barrels (27), the ring being connected to the cover (3) of the housing (1) by spring-loaded fasteners (55).

7. An epicyclic mill as in claim 1, characterized in that two additional rams (57) are fitted to the cover (3) of the housing (1) with provision for interacting with a flat pressure ring (54) when the rod (6) of the ram (7) of the revolving jib crane (9) is on a downstroke.

8. An epicyclic mill as in claim 1, characterized in that the lower disc (33) supported on the spindle (31) is linked to the carrier (18) by guide rods (59).

9. An epicyclic mill as in claim 1, characterized in that the jib (8) of the revolving jib crane (9) is linked to the cover (3) of the housing (1) by a guide pin (60).

10. An epicyclic mill as in claim 1, characterized in that the upper disc (43) is provided with an annular breaking lining (44).

11. An epicyclic mill as in claim 1, characterized in that arresters (49) of axial displacement of the upper disc (43) are secured to the lower disc (33).

* * * * *